US008567889B2

(12) United States Patent
Drury et al.

(10) Patent No.: US 8,567,889 B2
(45) Date of Patent: Oct. 29, 2013

(54) METHOD AND APPARATUS FOR DROPLET DEPOSITION

(75) Inventors: Paul R. Drury, Royston (GB); Julian R. Bane, Elsworth (GB); Alison Diane Morris, Cambridge (GB)

(73) Assignee: Xaar Technology Limited, Cambridgeshire (GB)

( * ) Notice: Subject to any disclaimer, the term of this patent is extended or adjusted under 35 U.S.C. 154(b) by 13 days.

(21) Appl. No.: 13/127,840

(22) PCT Filed: Nov. 12, 2009

(86) PCT No.: PCT/GB2009/051527

§ 371 (c)(1),
(2), (4) Date: Jul. 14, 2011

(87) PCT Pub. No.: WO2010/055345

PCT Pub. Date: May 20, 2010

(65) Prior Publication Data

US 2011/0261101 A1 Oct. 27, 2011

(30) Foreign Application Priority Data

Nov. 12, 2008 (GB) ..... 0820718.5

(51) Int. Cl.
*B41J 29/38* (2006.01)
*B41J 2/045* (2006.01)

(52) U.S. Cl.
USPC ..... 347/11; 347/69

(58) Field of Classification Search
None
See application file for complete search history.

(56) References Cited

U.S. PATENT DOCUMENTS

| | | | | |
|---|---|---|---|---|
| 5,512,922 | A * | 4/1996 | Paton | 347/12 |
| 6,045,209 | A | 4/2000 | Imai | |
| 6,217,148 | B1 * | 4/2001 | Adler et al. | 347/41 |
| 2004/0155915 | A1 | 8/2004 | Kitami et al. | |

FOREIGN PATENT DOCUMENTS

| | | | |
|---|---|---|---|
| EP | 0 422 870 | A2 | 4/1991 |
| EP | 1693202 | | 8/2006 |
| EP | 1 707 362 | A2 | 10/2006 |
| GB | 2 338 928 | A | 1/2000 |

(Continued)

OTHER PUBLICATIONS

International Search Report and Written Opinion for PCT/GB2009/051527 dated Mar. 15, 2010.

(Continued)

*Primary Examiner* — Geoffrey Mruk
(74) *Attorney, Agent, or Firm* — Marshall, Gerstein & Borun LLP

(57) ABSTRACT

Depositing droplets onto a substrate using an array of channels, acting as fluid chambers, separated by actuable walls. In response to a first voltage, each wall deforms to decrease the volume of one channel and increase the volume of the other channel, and, in response to a second voltage, the wall deforms so as to cause the opposite effect on the volumes of the neighboring channels. Receiving input data; assigning, based on the input data, all channels within the array as firing or non-firing to produce groups of one or more contiguous firing channels separated by groups of one or more contiguous non-firing channels; actuating walls of certain channels resulting in each of the firing channels releasing at least one droplet of fluid, the resulting droplets forming dots disposed on a straight line on a substrate, separated on the line by gaps corresponding to the non-firing channels.

10 Claims, 5 Drawing Sheets

(56) References Cited

FOREIGN PATENT DOCUMENTS

| | | | |
|---|---|---|---|
| JP | 2000-103054 | A | 4/2000 |
| WO | WO-96/10488 | A1 | 4/1996 |
| WO | WO-2006129071 | | 12/2006 |
| WO | WO-2007/007074 | A1 | 1/2007 |

OTHER PUBLICATIONS

Search Report for Application No. GB0820718.5, dated Feb. 25, 2009.

* cited by examiner

METHOD AND APPARATUS FOR DROPLET DEPOSITION

The present invention relates to a method and apparatus for droplet deposition and may find particular use within apparatus including fluid chambers separated by actuable walls.

In a particular example, the present invention relates to ink jet printers.

It is known within the art of droplet deposition apparatus to construct an actuator comprising an array of fluid chambers separated by a plurality of piezoelectric walls. In many such constructions, the walls are actuable in response to electrical signals to move towards one of the two chambers that each wall bounds; such movement affects the fluid pressure in both of the chambers bounded by that wall, causing a pressure increase in one and a pressure decrease in the other.

Nozzles or apertures are provided in fluid communication with the chamber in order that a volume of fluid may be ejected therefrom. The fluid at the aperture will tend to form a meniscus owing to surface tension effects, but with a sufficient perturbation of the fluid this surface tension is overcome allowing a droplet or volume of fluid to be released from the chamber through the aperture; the application of excess positive pressure in the vicinity of the aperture thus causes the release of a body of fluid.

An exemplary construction having an array of elongate chambers separated by actuable walls is shown in FIG. 1. The chambers are formed as channels enclosed on one side by a cover member that contacts the actuable walls; a nozzle for fluid ejection is provided in this cover member. The cover member will often comprise a metal or ceramic cover plate, which provides structural support, and a thinner overlying nozzle plate, in which the nozzles are formed.

As shown in FIG. 1, the actuation of the walls of a chamber may cause the release of fluid from that chamber through its aperture. In the case shown in FIG. 1, both the walls of a particular chamber are deformed inwards, this movement causing an increase in the fluid pressure within the channel and a decrease in pressure of the two neighbouring channels. The increase in pressure within that chamber contributes to the release of a droplet of fluid through the aperture of that chamber.

In constructions such as FIG. 1 where all chambers are provided with an aperture, every chamber may be capable of fluid release. It will be apparent however, that since the actuation of a particular wall has a different effect on the pressure in its two adjacent channels, simultaneous release of fluid from both of the channels separated by a particular wall is difficult to achieve.

There may be some asymmetry in the design of the apparatus to enable droplets released at different times to arrive on a substrate at the same time; for example, the nozzles may be located in different positions for different channels. During deposition the array will be moved relative to a substrate, thus two nozzles may be spaced in the direction of movement so that the spacing in position counteracts the difference in timing of droplet release. However, such constructional changes are permanent for an actuator and are thus able to compensate for only a specific pattern of droplet release timings; this leads to restriction of the methods used to drive the actuator walls.

A further complication caused by the actuation of a wall shared by two chambers is that residual pressure disturbances remain in the chamber after the actuation has occurred. Experiments carried out by the Applicant have led to the data shown in FIG. 2 for the displacement within a fluid (acting as a proxy for the pressure within the fluid) in two neighbouring chambers following a single movement of the dividing wall.

It is apparent from these data that the pressure in each chamber oscillates about the equilibrium pressure (the pressure present in a chamber where no deformation of the walls takes place), with the amplitude of oscillation decaying to zero over time. The time taken for the amplitude to decay to zero is referred to hereinafter as the relaxation time ($t_R$) for the system.

Without wishing to be bound by the theory the Applicant believes that the oscillation of pressure is caused by acoustic pressure waves reflected at the ends of the fluid chamber. The period ($T_A$) of these standing waves may be derived from a graph such as FIG. 2 and is known as the acoustic period for the chamber. In the case of a long, thin channel this period is approximately equal to L/c where L is the length of the channel and c is the speed of sound propagation along the chamber within the fluid.

As mentioned above, residual pressure waves are present in both chambers either side of a wall following the movement of that wall. The presence of such residual waves is apparent from the second and subsequent maxima in displacement shown in FIG. 2. Therefore, when fluid is released from a particular chamber, pressure disturbances may be present in one or both of the neighbouring chambers. For example, in some actuation schemes fluid is released from a particular chamber by the inward movement of both walls bounding that chamber, which will affect the pressure in both the neighbouring chambers. These pressure disturbances may interfere with fluid release from the neighbouring chambers in a process known as 'cross-talk'.

Actuator constructions have been proposed to ameliorate the problem of 'cross-talk'; for example, alternate chambers may be formed without apertures so that these 'non-firing' chambers act to shield the chambers with apertures—the 'firing' chambers—from pressure disturbances. It will of course be apparent that for a given chamber size this has the undesirable consequence of halving the resolution available.

EP 0 422 870 proposes to ameliorate cross-talk with actuation schemes that pre-assign each chamber to one of three or more groups or 'cycles'. The chambers in turn are cyclically assigned to one of these groups so that each group is a regularly spaced sub-array of chambers. During operation, only one group is active at any time so that chambers depositing fluid are always spaced by at least two chambers, with the spacing dependent on the number of groups. User input data determines which specific chambers within each group are actuated. In more detail, the chambers within a cycle chamber may each receive a different number of pulses corresponding to the number of droplets that are to be released by that chamber, the droplets from each chamber merging to form a single mark or print pixel on the substrate.

It will be apparent that at any one time only one third of the total number of chambers (or 1/n, where n is the number of cycles) may be actuated in this scheme and that therefore the rate of throughput is substantially decreased.

Additionally, the time delay between the firing of different groups can lead to the corresponding dots on the substrate being spaced apart in the direction of relative movement of the substrate and the apparatus. As noted briefly above, some apparatus constructions address this problem by offsetting the nozzles for each cycle, so that the nozzles for each cycle lie on a respective line, the lines being spaced in the direction of substrate movement, while this often successfully counteracts this particular problem, this construction is generally restricted to a particular firing scheme following nozzle formation.

EP 0 422 870 also proposes an actuator where the chambers are divided into two groups—odd-numbered and even-numbered chambers. Each group of chambers is synchronised to fire at the same time, with the specific input data determining which chambers within that group should be fired. The disclosure also discusses switching between the two groups at the resonant frequency of the chambers so that neighbouring chambers are fired in anti-phase.

It is noted in the document that this scheme grants a high throughput rate, but results in restrictions to the patterns that may be produced. For example, according to this scheme it is possible to print white-black-white, but not black-white-black.

Thus, there exists a need for a droplet deposition apparatus that has an increased throughput rate with less restriction in the patterns that may be produced.

Thus, according to a first aspect of the present invention there is provided a method for depositing droplets onto a substrate utilising an apparatus comprising: an array of fluid chambers separated by interspersed walls, each fluid chamber being provided with an aperture and each of said walls separating two neighbouring chambers; wherein each of said walls is actuable such that, in response to a first voltage, it will deform so as to decrease the volume of that chamber and increase the volume of the other chamber, in response to a second voltage, it will deform so as to cause the opposite effect on the volumes of said neighbouring chambers; the method comprising the steps of:

receiving input data; assigning, based on said image input data, all the chambers within said array as either firing chambers or non-firing chambers so as to produce groups of one or more contiguous firing chambers separated by groups of one or more contiguous non-firing chambers; actuating the walls of certain of said chambers such that: for each non-firing chamber, either the walls move with the same sense or they remain stationary; and for each firing chamber, either the walls move with opposing senses, or one wall is stationary while the other is moved; said actuations resulting in each said firing chamber releasing at least one droplet, the resulting droplets forming dots disposed on a line on said substrate, said dots being separated on said line by gaps corresponding to said non-firing chambers.

While several methods have been proposed for operating the walls of firing chambers, these disclosures are typically silent on the operation of the walls of non-firing chambers.

By contrast, this method of governing the behaviour of walls of both firing and non-firing chambers allows a spacing of a single non-firing chamber to exist between firing chambers, so that a pattern of 'black-white-black' may be formed. The Applicant has made the realisation that, as non-firing chambers by definition separate regions of firing chambers, to achieve a high throughput, the non-firing chambers must be highly resistant to the effects of the surrounding firing chambers being actuated, and control of their walls is of great importance.

This is especially the case with detailed patterns, since in such cases only a few non-firing chambers may separate regions of firing chambers, and thus 'edge-effects' significantly effect the non-firing chambers.

According to one embodiment of the present invention, the walls of the non-firing chamber remain stationary, while only one wall of each firing chamber is moved to effect droplet release.

Preferably, said actuations comprise two half-cycles, with half of all firing chambers being assigned to a first half-cycle and the other half of all firing chambers being assigned to a second half-cycle, wherein the firing chambers in each half-cycle release droplets substantially simultaneously. Thus, all actuations may be completed within a single cycle, hence the throughput is dramatically increased in comparison to multi-cycle processes as described in EP 0 422 870.

Further, the walls of non-firing chambers may advantageously be moved, with this movement acting to perturb fluid at the aperture of the non-firing chamber. Moving the meniscus formed at the aperture inhibits stagnation of fluid, which could otherwise lead to particles within the fluid becoming accumulated at the aperture, thus causing a blockage that interferes with fluid ejection.

In contrast to known apparatus discussed above, apparatus adapted to carry out a method according to the present invention may advantageously have the apertures for substantially all fluid chambers are disposed on a line, thus greatly simplifying integration of the print head or other droplet deposition apparatus within a printer or other larger system and also allowing a variety of actuation schemes falling within the scope of the present invention to be used.

The invention will now be described with reference to the accompanying drawings, in which.

Figure 1:
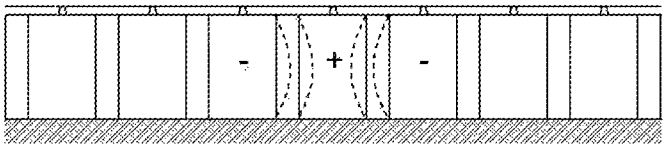
Figure 1 (PRIOR ART)
FIG. 1 shows a known construction of a droplet deposition apparatus.
Figure 2:
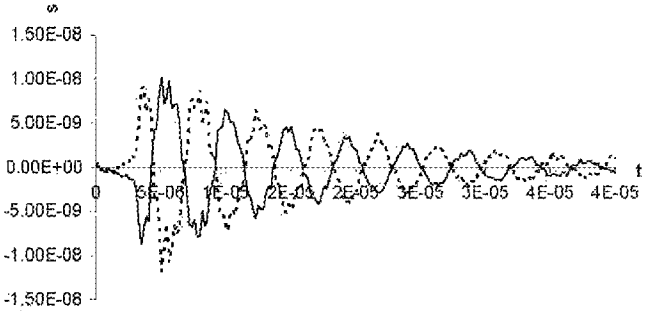
FIG. 2 shows the pressure response in two neighbouring chambers following the deformation of the wall separating the chambers.

The apparatus shown in FIG. 1 may be used to carry out a method of droplet deposition in accordance with the present invention, and comprises an array, extending in an array direction, of fluid chambers formed as channels or elongate chambers, each having a longitudinal axis extending in a channel extension direction, so that each channel is elongate in this direction. The channel extension direction will preferably be perpendicular to the array direction. The channels are separated by a corresponding array of elongate channel walls formed of a piezoelectric material (such as PZT) so that each channel is thus provided with two opposed side walls running along the length of the chamber.

In order to provide maximal density of deposited droplets, preferably every channel or chamber within the array is filled with an ejection fluid, such as an ink, during use and provided with an aperture or nozzle for ejection of the fluid.

In the particular construction of FIG. 1, each such channel is coated internally with a metal layer that acts as an electrode, which may be used to apply a voltage across the walls of that chamber and thus cause the walls to deflect or move by virtue of the piezoelectric effect. The voltage applied across each wall will thus be the difference between the signals applied to the adjacent channels. Where a wall is to remain undeformed, there must be no difference in potential across the wall; this may of course be accomplished by applying no signal to either of the adjacent channel electrodes, but may also be achieved by applying the same signal to both channels.

The piezoelectric walls may preferably comprise an upper and a lower half, divided in a plane defined by the array direction and the channel extension direction. These upper and lower halves of the piezoelectric walls may be poled in opposite directions perpendicular to the channel extension and array directions so that when a voltage is applied across the wall perpendicular to the array direction the two halves deflect in 'shear-mode' so as to bend towards one of the fluid chambers; the shape adopted by the deflected resembles a chevron.

Other methods of providing electrodes and poling walls have been proposed, which afford the ability to deflect the walls in a similar bending motion. For example, each wall may consist of two oppositely poled halves, where the halves are divided by a plane perpendicular to the array direction. In such a construction, electrodes may be provided at the top and bottom of each wall. Those skilled in the art will appreciate that different electrode schemes are effectively interchangeable and that chambers may be provided with more than one electrode depending on the requirements of the particular application.

Figure 3A:
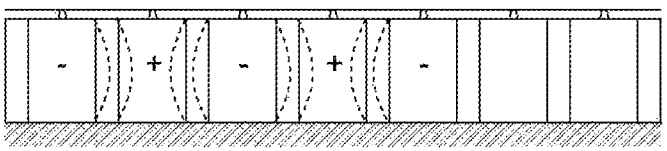
Figure 3(a) (PRIOR ART)
FIG. 3(*a*) shows the droplet deposition apparatus of FIG. 1 undergoing a different series of actuations, while FIG. 3(*b*) is a simplified representation of the same series of actuations.
Figure 3B:
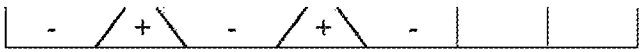
Figure 3(b) (PRIOR ART)

FIG. 3(*a*) shows the apparatus of FIG. 1 undergoing a different series of actuations, where two chambers experience an increase in pressure owing to inward movement of both of their walls leading to a decrease in the volume of those chambers. As may also be seen in the figure, this inward movement causes a pressure decrease in the neighbouring chambers as the same wall movement acts to increase the volumes of those chambers. FIG. 3(*b*) shows the same series of actuations using a simplified representation, where the walls are represented by diagonal or vertical lines: the direction of deflection of a wall is represented by the direction in which the line extends so that an undeformed wall is represented by a vertical line.

At this level of abstraction it becomes apparent that the invention is not limited to use with a specific actuator construction, but is more generally concerned with the operation of droplet deposition apparatus having deformable walls shared by neighbouring chambers within an array, the nature of the deformation being such that more volume is displaced in one chamber than the other chamber. Put differently, when compared to its undeformed or undeflected shape, the thus-deformed wall occupies more space in one chamber than in the other chamber.

Apparatus such as that depicted in FIG. 1 is commonly referred to as a 'side-shooter' owing to the placement of the nozzle approximately in the side of the fluid chambers; the nozzle is commonly provided equidistant of each end. In such constructions, the ends of the channels will often be left open to allow all channels to communicate with one or more common fluid manifolds. This further allows a flow to be set up along the length of the channel during use of the apparatus so as prevent stagnation of the fluid and to sweep detritus within the fluid away from the nozzle. It is often found to be advantageous to make this flow along the length of the channel greater than the maximum flow through the nozzle due to fluid release. Put differently, when the apparatus is operated at maximum ejection frequency the average flow of fluid through each nozzle is less than the flow along each channel. Preferably this flow is at least five or more preferably still, ten times greater than the maximum flow through the nozzle due to fluid release.

Figure 4B:
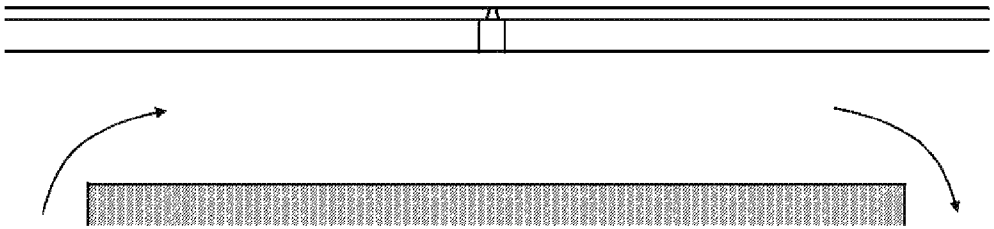
FIG. 4(*a*) shows an end-view and FIG. 4(*b*) a side-view of a still further exemplary construction of a droplet deposition apparatus where each chamber opens onto a manifold at opposing ends.
Figure 4A:
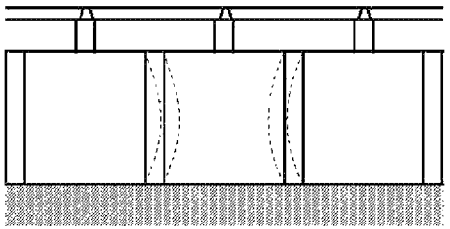

FIGS. 4(*a*) and 4(*b*) show a further example of a 'side shooter' construction, in which a cover plate encloses the array of chambers and a nozzle plate overlies this cover plate; for each chamber, a corresponding ejection port is formed in the cover plate, which communicates with the chamber and a nozzle to enable ejection of fluid from that chamber through the nozzle. The chambers open at either end of their lengths onto a common fluid supply manifold; separate common manifolds may be provided for each end or a single manifold for both ends may be provided. Movements of the piezoelectric walls separating the array of chambers generate acoustic waves within the chambers, which are reflected at the boundary between the chamber and the common manifold due to the difference in cross-section area. These reflected waves will be of opposite sense to the waves incident on the channel ends, owing to the 'open' nature of the boundary. Further, a flow of fluid along each chamber may be set up as described with reference to FIG. 1, as is shown in the view parallel to the array of channels in FIG. 4(*b*).

Figure 5B:
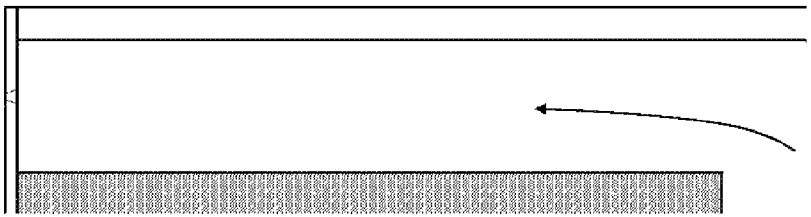
FIG. 5(*a*) shows an end-view and 5(*b*) a side-view of yet a further exemplary construction of a droplet deposition apparatus where each chamber opens onto a manifold at only one end.
Figure 5A:
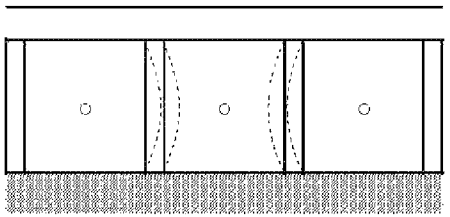

FIGS. 5(*a*) and 5(*b*) show an example of an 'end-shooter' construction, where nozzles are formed in a nozzle plate closing one end of each chamber, the other end of each chamber opening on to a fluid supply manifold common to all chambers. In certain 'end-shooter' constructions, such as that proposed in WO2007/007074, a small channel may be formed in the base in proximity to the nozzle for egress of fluid from the chamber. The channel is of much smaller cross-section than the chamber so as to effectively form a barrier to acoustic waves within the chamber. A flow of fluid may be set up along the length of each chamber, with fluid entering from the common manifold and leaving via the small channel provided adjacent each nozzle.

Figure 6B:
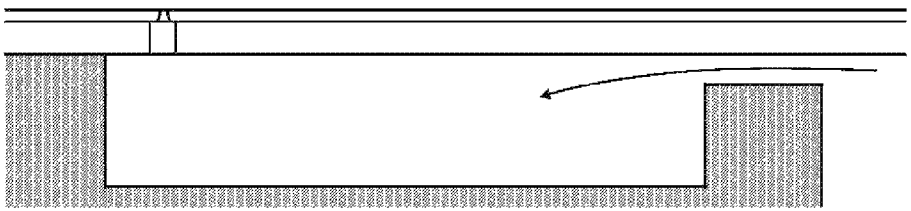
FIG. 6(*a*) shows an end-view and 6(*b*) a side-view of a still further exemplary construction of a droplet deposition apparatus where a small passage connects each chamber to a manifold.
Figure 6A:
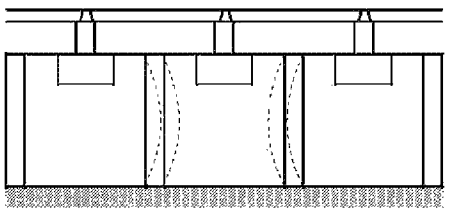

FIGS. 6(*a*) and 6(*b*) show a still further example of a droplet deposition apparatus that may be used in accordance with the present invention. This construction provides a nozzle plate and cover plate similar to that described with reference to FIGS. 4(*a*) and 4(*b*), but with each nozzle provided towards one end in the side of the corresponding chamber. A support member defines each channel base and substantially closes each chamber at both ends of its length, with the exception of a small channel provided at the opposite end of the chamber to the nozzle. This small channel allows the ingress of fluid for ejection from the chamber through the nozzle, but has a very much smaller cross-section than the chamber itself so as to act as a barrier to acoustic waves within the chamber from reaching the supply manifold. Any acoustic waves generated by movements of the piezoelectric walls will thus be reflected by both ends of the chamber as waves of the same sense.

It will be appreciated that the present invention is susceptible of use with all the above-described apparatus and more generally with apparatus comprising an array of chambers separated by actuable walls, where each chamber is provided with an aperture for droplet ejection.

As is noted above, many schemes have been proposed for the ejection of fluid from the nozzles of an array of fluid chambers divided by actuable walls. Previously proposed ejection schemes relying on the concept of cycles may operate only a predetermined group of chambers at any one time. The chambers within a group are typically spaced by (n−1) non-firing chambers, where n is the number of cycles. Based on the input data received by the apparatus, certain of the chambers within the group are actuated so as to produce drops.

It will be appreciated that droplets from different cycles will therefore be released at different times; this is typically corrected for by spacing in the substrate movement direction the lines on which the nozzles for each group are disposed. The order in which the lines of nozzles for the groups appear is the same as the order in which the groups are activated and the spacing is chosen such that the droplets from all groups are deposited on a single line. It will be appreciated that the group to which a particular chamber belongs is thus fixed owing to the position of its nozzle.

Similarly, in the case presented in EP 0 422 870 where chambers are assigned as either even or odd, this assignment is fixed for a particular apparatus when the electrode structure is formed and thus no change is possible.

By contrast, the present invention allows any chambers to be selected for droplet deposition, allowing a precise registration between the input data and the pattern produced while maintaining a high level of throughput.

Figures 7A, 7B, 8A, 8B, 9A, 9B:
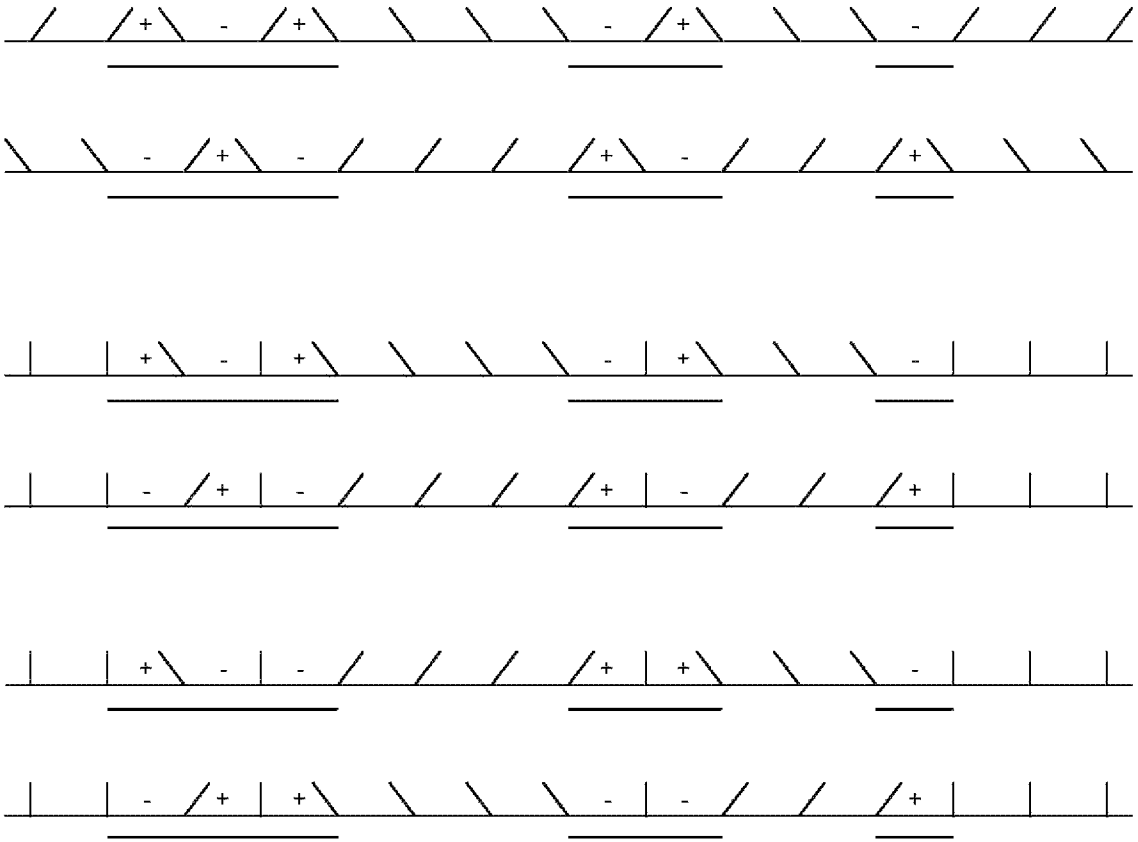
FIG. 7 is a representation of a method of operating a droplet deposition apparatus to produce a first pattern according to a first embodiment of the present invention, where all walls are continuously active.
FIG. 8 is a representation of a method of operating a droplet deposition apparatus to produce the same pattern as FIG. 7 according to a further embodiment of the present invention.
FIG. 9 is a representation of a method of operating a droplet deposition apparatus to produce the same pattern as FIG. 7 according to a still further embodiment of the present invention.

FIG. 7 shows a method according to a first embodiment of the present invention where all walls within the actuator are moved regardless of which channels release droplets. Based on input data, certain of the chambers within the array are assigned as firing chambers and will deposit droplets, while the remaining chambers are assigned as non-firing chambers. In the figures, the horizontal lines beneath the chambers indicate the firing chambers. Each wall within the actuator oscillates about its undeformed state and may belong to one of two groups, the two groups oscillating in anti-phase with the same period of oscillation.

FIG. 7(*a*) shows a point in the actuation cycle where the walls of both groups are at one extreme of their motion, whereas FIG. 7(*b*) shows the point half a cycle later, when the walls are at the opposite extreme. It will be apparent that the two walls of each non-firing chamber remain in phase throughout the motion, so that they are moving with the same sense. Therefore, there will be little if any reduction in the volume of the non-firing chambers and ejection will not occur. By contrast, the walls of each firing chamber move in anti-phase so that they are moving throughout with opposite sense and act to alternately increase and reduce the volume of the firing chambers. As will be apparent, the anti-phase motion of the walls of firing chambers will cause an oscillation in the pressure of the fluid throughout the channel. Depending on its magnitude, this pressure oscillation may cause or contribute to the deposition of a fluid droplet from that channel. The magnitude will, of course, be directly related to the amplitude of the wall oscillations so that a high-amplitude oscillation will cause droplet release, but it is known that the lifetime of piezoelectric material is reduced as the amplitude of oscillations is increased.

It may therefore be beneficial to take account of modal effects within the actuator structure so as to reduce the amount of energy required to effect droplet release. Clearly, any chamber containing fluid will have one or more natural frequencies for pressure oscillation, which may result from various factors such as the compliance and geometry of the chamber. In particular, when a wall is deformed, an acoustic pressure wave may be set up within the chamber. Specifically, when the volume of a chamber is increased by movement of a wall away from that chamber, a negative pressure wave is generated at the nozzle of the chamber, which propagates away from the nozzle.

In the case of a long thin chamber having open ends, the open ends constitute a mismatch of acoustic impedances and thus will act as such wave-reflecting acoustic boundaries. Acoustic waves propagating along the length of the channel will therefore be reflected by these boundaries but—owing to the 'open' nature of the boundaries—the reflected waves will be of opposite sense to the original wave. By synchronising the oscillation of the chamber walls with the arrival of acoustic waves at or near the chamber aperture, the pressure generated by wall deformation may combine with the acoustic wave pressure to enable controlled ejection. In the case of a long thin chamber having open ends, the acoustic waves take a time L/2c (where L is the length of the channel and c is the speed of sound for the particular combination of fluid and chamber) to travel from the open ends to an aperture equidistant from the ends. Thus, the frequency of oscillation of these waves is approximately L/c; by operating the chamber walls at a multiple of this frequency, controlled droplet release may be achieved with reduced energy input. In general, a higher frequency will lead to faster operation of the apparatus and thus a frequency of approximately L/c may be desirable.

The oscillation in-phase of the walls of each non-firing channel does not cause a sufficient increase in the channel pressure to cause ejection, but may perturb the meniscus of fluid at the chamber aperture so as to prevent stagnation of the fluid and thus the blockage of the aperture.

It will be apparent from FIGS. 7(*a*) and 7(*b*) that during each half-cycle, half of the firing chambers will release droplets. In order to synchronise the release of droplets across the array it is advantageous that this release is carried out substantially simultaneously. It will, of course, be appreciated that this synchronisation of 'half' of the firing channels is intended to include the situation where an odd number of firing channels is present as a contiguous region and thus the number of firing chambers in each 'half' of this region will differ by one. For example, in a region of five contiguous firing chambers, two may release droplets during the first half-cycle and the remaining three may release droplets during the second half-cycle, or vice versa.

FIGS. 8(*a*) and 8(*b*) show a method of operating a droplet deposition apparatus according to a further embodiment of the invention. The pattern of firing and non-firing chambers shown in these figures is identical to that shown in FIGS. 7(*a*) and 7(*b*). In this embodiment each wall may be assigned to one of two groups: an oscillating group and a group which remains stationary or has negligible amplitude in comparison. The movement of the walls belonging to the first group is apparent from the difference between FIG. 8(*a*) and FIG. 8(*b*), which show the actuator at points half a cycle apart. As in the embodiment of FIG. 7(*a*) and FIG. 7(*b*) the walls of the firing chambers are assigned to different groups, whereas the walls of the non-firing chambers are assigned to the same group. Thus, the walls of each non-firing chamber are either moved in the same sense or they remain stationary, hence in both cases there is substantially no change in the volume of the non-firing chambers. By contrast, in the firing chambers one of the walls is moved while the other remains stationary so that the volume oscillates and hence causes the ejection of droplets.

It will be apparent to those skilled in the art that where a stationary wall is present within an array, the oscillations on either side of the wall need not be in phase. Thus, the embodiment of FIG. 9(*a*) and FIG. 9(*b*) has the outer walls of a pair of firing chambers separated by a stationary wall moving in anti-phase. In this embodiment, the walls are assigned to one of three groups: two groups moving in anti-phase and a third group which is stationary or has negligible amplitude in comparison.

In still further embodiments, the number of groups that a wall may be assigned to may be increased still further. For example, in firing regions every other wall may be stationary so that phases of the remaining walls may be chosen according to a scheme or randomised. Randomising the phases of the remaining walls may aid in reducing modal interactions between the firing channels.

Figures 10A, 10B, 11A, 11B, 12A, 12B:
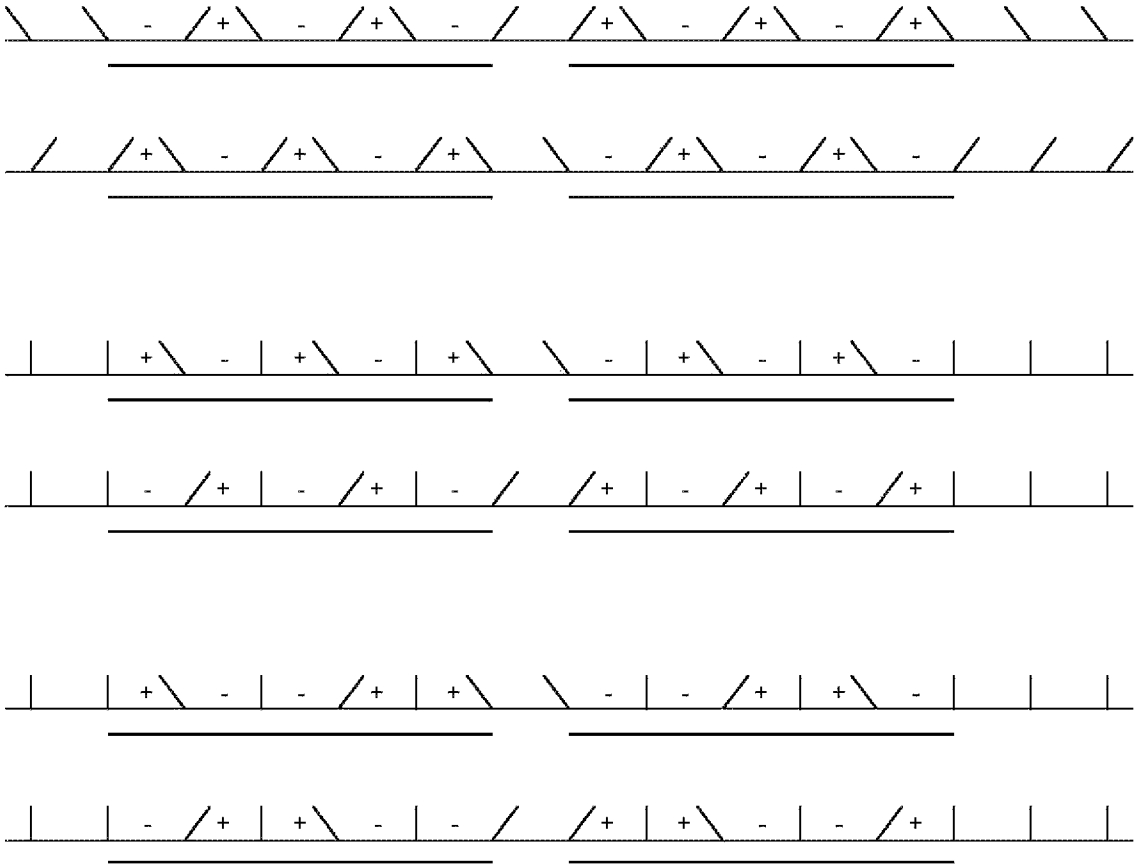
FIG. 10 is a representation of the method operating a droplet deposition apparatus shown in FIG. 7 when used to produce a second pattern.
FIG. 11 is a representation of a method of operating a droplet deposition apparatus shown in FIG. 8 when used to produce the same pattern as FIG. 10.
FIG. 12 is a representation of a method of operating a droplet deposition apparatus shown in FIG. 9 when used to produce the same pattern as FIG. 10.

FIGS. 10(*a*) and 10(*b*) illustrate the same method of operating a droplet deposition apparatus as is shown in FIG. 7(*a*) and FIG. 7(*b*) when applied to deposit droplets in a different pattern. The pattern is chosen to consist of two groups of five firing chambers separated by a single chamber. Crucially, such patterns involving a single chamber spacing may not be printed using the system disclosed in EP 0 422 870. As before, the walls of the spacing chamber oscillate in phase so that no net reduction of the chamber volume occurs and thus droplet release in avoided, but small the pressure perturbations caused by the movements of the wall prevent fluid stagnation and encourage later droplet release when required.

FIGS. 11(*a*) and 11(*b*) illustrate the same method of operation as FIG. 8(*a*) and FIG. 8(*b*), when applied to deposit droplets in the same pattern as FIGS. 10(*a*) and 10(*b*); similarly, FIGS. 12(*a*) and 12(*b*) depict formation of the same pattern with the method of operation shown in FIGS. 9(*a*) and 9(*b*).

Figure 13:
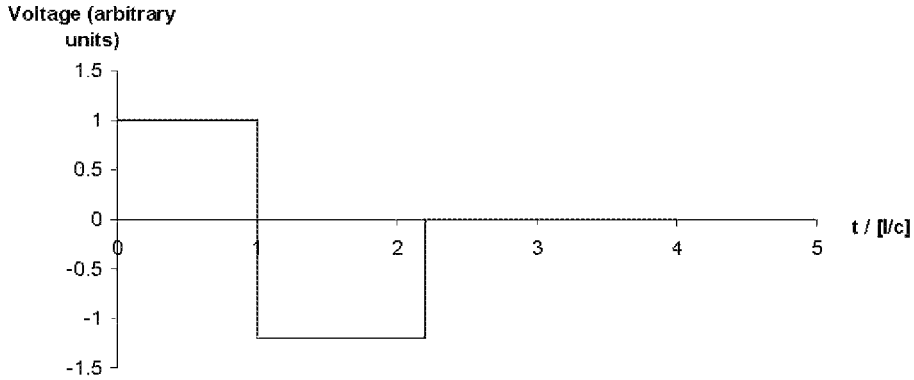
FIG. 13 shows an ejection waveform that may be applied to the wall of a firing channel.

FIG. 13 shows an ejection waveform that may be applied across a wall separating two firing channels of an apparatus such as that illustrated in FIG. 4; this waveform corresponds to the potential difference between the signals at the adjacent channel electrodes. Where it is desired to produce a bipolar voltage across a wall with such a construction, this may be accomplished by applying one unipolar signal to each of the neighbouring electrodes, so that one signal provides positive portions of the voltage across the wall and the other signal provides negative portions.

There is a direct relationship between the voltage across the wall and the position of the wall: where the voltage difference is held at zero the wall is undeformed; where the voltage is held at a positive value the wall is deformed towards the first chamber and where the voltage is held at a negative value the wall is deformed towards the second chamber. The movement of the wall will tend to lag behind the voltage signal owing to the response time of the system.

The ejection waveform comprises two square wave portions: the first portion corresponding to a movement towards the first channel and after a first period of time a movement back to an undeformed position, and the second portion corresponding to a movement towards the second channel and after a second period of time a movement to revert to its undeformed state. During operation, the first portion contributes to the release of a droplet from the first chamber, while the second portion contributes to the release of a droplet from the second chamber.

Where the time spacing between first and second portions is of a similar magnitude to the response time of the system the wall may move directly from deformation towards the first chamber to deformation towards the second chamber with no appreciable pause in its undeformed state and may thus be considered a single continuous movement from first chamber to second.

An alternative waveform comprises the same portions preceded by similar portions (pre-pulses) which do not cause ejection directly, but rather initiate acoustic waves which are then reinforced by the further pressure pulses generated by the main waveform portions.

As is discussed above, the movements of the walls may be timed to coincide with the presence at the nozzle of acoustic wave pulses so as to reduce the energy required for ejection. This may, for example, be accomplished by having the leading edge of the second waveform portion at a time approximately L/c after the leading edge of the first waveform portion.

As will be apparent from FIG. 13, the second portion is longer and has a greater amplitude: thus, the energy imparted by the second portion is greater than the first. This will result in the second droplet being released with greater velocity than the first, and may also result in the two droplets having different volumes. By altering the lengths and amplitudes of the wave portions, it is possible to arrive at a waveform giving equal volumes but different speeds. The difference in speeds may then be utilised to ensure that the two droplets land on a substrate substantially simultaneously and thus are aligned relative to the direction of substrate movement. Extending this principle to all firing chambers, it is possible to ensure the formation of a line of droplets on the substrate.

It will be appreciated that in practice each droplets of fluid may not all be exactly centred on a line on the substrate, but that a straight line will at least pass through all the spots; put differently, the droplets are disposed on a single line.

By depositing several such lines of droplets on a substrate a two-dimensional array of droplets can be created, with individual control over the deposition of every droplet. It will therefore be apparent that the present invention may be of particular benefit in printing images or forming two-dimensional patterns. In the case of image formation, each line of droplets may represent a line of image data pixels and any error inherent in the representation of each line may be distributed to neighbouring lines using a process such as dithering.

Figure 14:
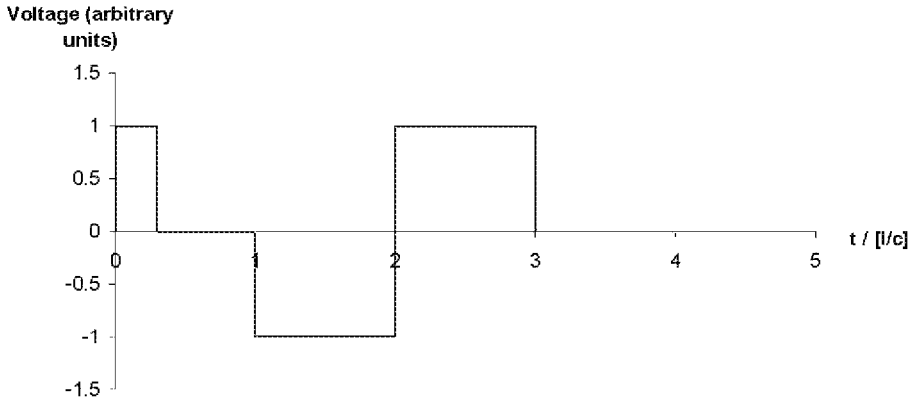
FIG. 14 shows a further ejection waveform that includes a non-ejection pulse.

According to a still further embodiment, the waveform causing ejection of the second droplet may be preceded by an additional waveform portion or 'pre-pulse'. As shown in FIG. 14, this pre-pulse is of shorter duration and thus lesser energy than the later pulses causing ejection. The pre-pulse does not immediately lead to ejection but initiates acoustic waves whose energy increases the velocity of the second droplet and thus serves to align the two droplets on the substrate. Such waveforms may be applicable in situations where control over the amplitude of the voltage is not available.

In yet further embodiments, the timing between successive ejections may be sufficiently small such that groups of droplets thus produced merge into a single dot on the substrate. Merging of the ejection fluid may take place at the nozzle of the apparatus, during flight of the droplets to the substrate or on the substrate itself. Each droplet is of nominally identical volume, so that the size of the spot of fluid on the substrate is quantized, thus providing an alternative to varying the size of a droplet through modulation of the amplitude and width of the corresponding waveform. Further, in such cases it may be advantageous to include pre-pulses (as described above) before a group of actuations—or packet—leading to a single spot on the substrate. As before, an appropriate number of pre-pulses may be chosen for each chamber so that the additional acoustic wave energy leads to the alignment of droplets on the substrate.

While the above exemplary embodiments make reference to waveforms comprising square wave portions, it will be appreciated by those skilled in the art that waveform portions of various forms such as triangular, trapezoidal, or sinusoidal waves may be used as appropriate depending on the particular deposition apparatus.

Further, as is discussed above, the present invention may be applied to both 'side-shooter' or 'end-shooter' type apparatus and more generally to any apparatus having an array of chambers separated by actuable walls. Further, while particular electrode arrangements have been described, the skilled person will appreciate that the present invention is not so limited.

Of course, while the invention may have particular benefit in graphics applications where a printed image is formed of pigment or ink using an inkjet printer, the advantages of the present invention will be afforded with many types of droplet deposition apparatus, substrate and ejection fluids, including the use of functional fluids capable of forming electronic components, uniform coating of large areas (e.g. varnishes) and the fabrication of 3 dimensional components.

The invention claimed is:

1. Method for depositing droplets onto a substrate utilizing an apparatus comprising:

an array of fluid chambers separated by interspersed walls, each fluid chamber communicating with an aperture for the release of droplets of fluid and each of said walls separating two neighboring chambers; wherein each of said walls is actuable such that, in response to a first voltage, it will deform so as to decrease the volume of one chamber and increase the volume of the other chamber, in response to a second voltage, it will deform so as to cause the opposite effect on the volumes of said neighboring chambers;

the method comprising the steps of:

receiving input data;

assigning, based on said input data, all the chambers within said array as either firing chambers or non-firing chambers so as to produce groups of one or more contiguous firing chambers separated by groups of one or more contiguous non-firing chambers;

actuating the walls of certain of said chambers such that:

for each non-firing chamber, either the walls move with the same sense or they remain stationary; and for each firing chamber, either the walls move with opposing senses, or one wall is stationary while the other is moved;

said actuations resulting in each said firing chamber releasing at least one droplet, the resulting droplets forming dots disposed on a line on said substrate, said dots being separated on said line by gaps corresponding to said non-firing chambers;

receiving further input data; and carrying out a second assigning step and a second actuating step, based on said further input data, the resulting droplets forming a second series of dots disposed on a second line on said substrate, said second series of dots being separated on said second line by a second series of gaps corresponding to the non-firing chambers of said second actuating step.

2. Method according to claim 1, wherein said actuations comprise two half-cycles, with half of all firing chambers being assigned to a first half-cycle and the other half of all firing chambers being assigned to a second half-cycle, wherein the firing chambers in each half-cycle release droplets substantially simultaneously.

3. Method according to claim 2, wherein said actuations cause the release of a train of n droplets (where n is an integer greater than 1) from each firing chamber in said first half-cycle, and also cause the release of a train of m droplets from each firing chamber in said second half-cycle, wherein m differs from n by at most 1 and wherein each such train of droplets forms a single dot on said substrate.

4. Method according to claim 3, wherein trains of the same number of droplets are released from all firing chambers.

5. Method according to claim 4, wherein any error inherent in the representation of one line of image data pixels by a line of fluid droplets is redistributed to another line of image data pixels.

6. Method according to claim 1, wherein for each non-firing chamber the walls move substantially in phase and for each firing chamber the walls move substantially in anti-phase.

7. Method according to claim 1, wherein the walls of each said firing chamber oscillate at or close to a multiple of the Helmholtz frequency for that chamber.

8. Method according to claim 1, wherein said input data corresponds to a two-dimensional array of image data pixels and said line of droplets is a representation of the values of a single line of image data pixels within said two-dimensional array.

9. A method according to claim 1, wherein the pattern of dots and gaps on said line corresponds to the pattern of firing and non-firing chambers within said array.

10. A method according to claim 1, wherein, following said steps of receiving input data and receiving further input data, said first and second assigning steps, and said first and second actuating steps, the pattern of dots and gaps on said first line corresponds to the pattern of firing and non-firing chambers within said array during said first actuating step and the pattern of dots and gaps on said second line corresponds to the pattern of firing and non-firing chambers within said array during said second actuating step.

* * * * *

UNITED STATES PATENT AND TRADEMARK OFFICE

CERTIFICATE OF CORRECTION

PATENT NO. : 8,567,889 B2
APPLICATION NO. : 13/127840
DATED : October 29, 2013
INVENTOR(S) : Drury et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 77 days.

Signed and Sealed this
Fifteenth Day of September, 2015

Michelle K. Lee

Michelle K. Lee
*Director of the United States Patent and Trademark Office*